United States Patent [19]

McDowell

[11] Patent Number: 4,702,023

[45] Date of Patent: Oct. 27, 1987

[54] CUTTER WHEEL FOR A DREDGE

[75] Inventor: Alexander W. K. McDowell, Annapolis, Md.

[73] Assignee: Ellicott Machine Corporation, Baltimore, Md.

[21] Appl. No.: 913,459

[22] Filed: Sep. 30, 1986

[51] Int. Cl.[4] ..... E02F 3/88

[52] U.S. Cl. ..... 37/66; 37/DIG. 2

[58] Field of Search ..... 37/66, 70, 189, 190, 37/DIG. 2

[56] References Cited

U.S. PATENT DOCUMENTS

| | | | |
|---|---|---|---|
| 388,252 | 8/1888 | Bowers | 37/66 |
| 3,476,498 | 11/1969 | Von Bolhar | 37/66 X |
| 3,823,495 | 7/1974 | Robertson | 37/66 |
| 4,242,814 | 1/1981 | Fluks | 37/66 |
| 4,302,893 | 12/1981 | Elshout et al. | 37/66 |
| 4,397,106 | 8/1983 | McDowell | 37/66 X |

FOREIGN PATENT DOCUMENTS

| | | | |
|---|---|---|---|
| 1207355 | 9/1970 | United Kingdom | 37/66 |

*Primary Examiner*—Clifford D. Crowder

*Attorney, Agent, or Firm*—Scrivener and Clarke

[57] ABSTRACT

A cutter wheel for a cutter wheel type dredge has a pair of axially spaced wheel parts each carrying peripherally mounted scoops and a centrally mounted hopper. The scoops have open sides, bottoms and rear ends and the hopper has open sides with which the open sides of the scoops align. As the wheel rotates spoil is flushed laterally from the scoops into the hopper by the flow of water into the suction pipe at the bottom of the hopper. The rear of the scoops are elongated and have open ends to permit sticking soil to be flushed into the following scoop as the scoops are moved through water and scraper arms remove whatever spoil might remain in the scoops, thus ensuring the removal from the scoops of all spoil without the necessity of utilizing power to jet flush away sticking soil or stopping operations to remove spoil by hand.

11 Claims, 4 Drawing Figures

CUTTER WHEEL FOR A DREDGE

This invention relates to dredges and more particularly to an improved cutter wheel for a cutter wheel type dredge.

In my earlier U.S. Pat. No. 4,397,106 I disclose a cutter wheel particularly adapted to placer dredging, by which is meant a cutter wheel which may operate against a bank or bottom while only partially submerged, usually for the mining of minerals. Because placer dredging often involves the digging of sticky spoil which adheres to the interior of the scoops and thus effectively stops digging action, it has been necessary to stop operations until the sticky spoil could be dislodged by hand. This was a tedious process and entailed considerable lost time during which the dredging operation was producing no monetary return. In order to shorten and even eliminate these unproductive periods and as described in the above patent, I devised a novel jet arrangement wherein a stream of water could be directed intermittently or continuously into the buckets to dislodge material sticking therein. In many areas it was and is necessary to operate the jet continuously and though this arrangement is quite satisfactory for its intended purpose of permitting uninterrupted operation of the dredge, operation of the jet called for a large proportion of the total power available to operate all of the dredging equipment. Thus the advantage of continuous operation was off-set to a certain extent by reduced production due to the decreased power for dredging in order to operate the jet pump.

The object of the present invention is to provide a cutter wheel which is continuously self-flushing during dredging so that no additional power is required to operate a flushing jet.

The foregoing object is achieved, in accordance with the invention, by the use of a dual cutter wheel whereby two sets of scoops are driven in unison on opposite sides of a hopper mounted between the scoops. The sides of the hopper are open and the inner sides of the scoops are likewise open at least where they align with the open sides of the hopper. As the scoops are rotated to dig spoil, plate means carried by the lower part of the hopper retain the spoil in each scoop until it has been elevated to a position where it is swept laterally through the aligned open sides of the scoop and hopper, primarily by the suction of the suction pipe which enters the bottom of the hopper in the mid-plane thereof. Each scoop has a rearwardly extending housing part open at its inner or hopper sides as well as its rear end, the latter being positioned so that any spoil which is not flushed laterally through the aligned openings to the hopper is flushed rearwardly by the relative movement of the scoop through the water so that the spoil is flushed into the next following scoop. In accordance with the invention, the rear opening must be located close enough to the mouth of the next following scoop to ensure that flushed-out spoil will enter the next scoop and not flow to one side. The mouths of the scoops flare outwardly, and are preferably provided with teeth, in order that each scoop may dig spoil without being unduly occluded by the rear of the scoop next ahead.

The invention will be better understood when the following detailed description is read in conjunction with the drawings wherein.

Figure 2:
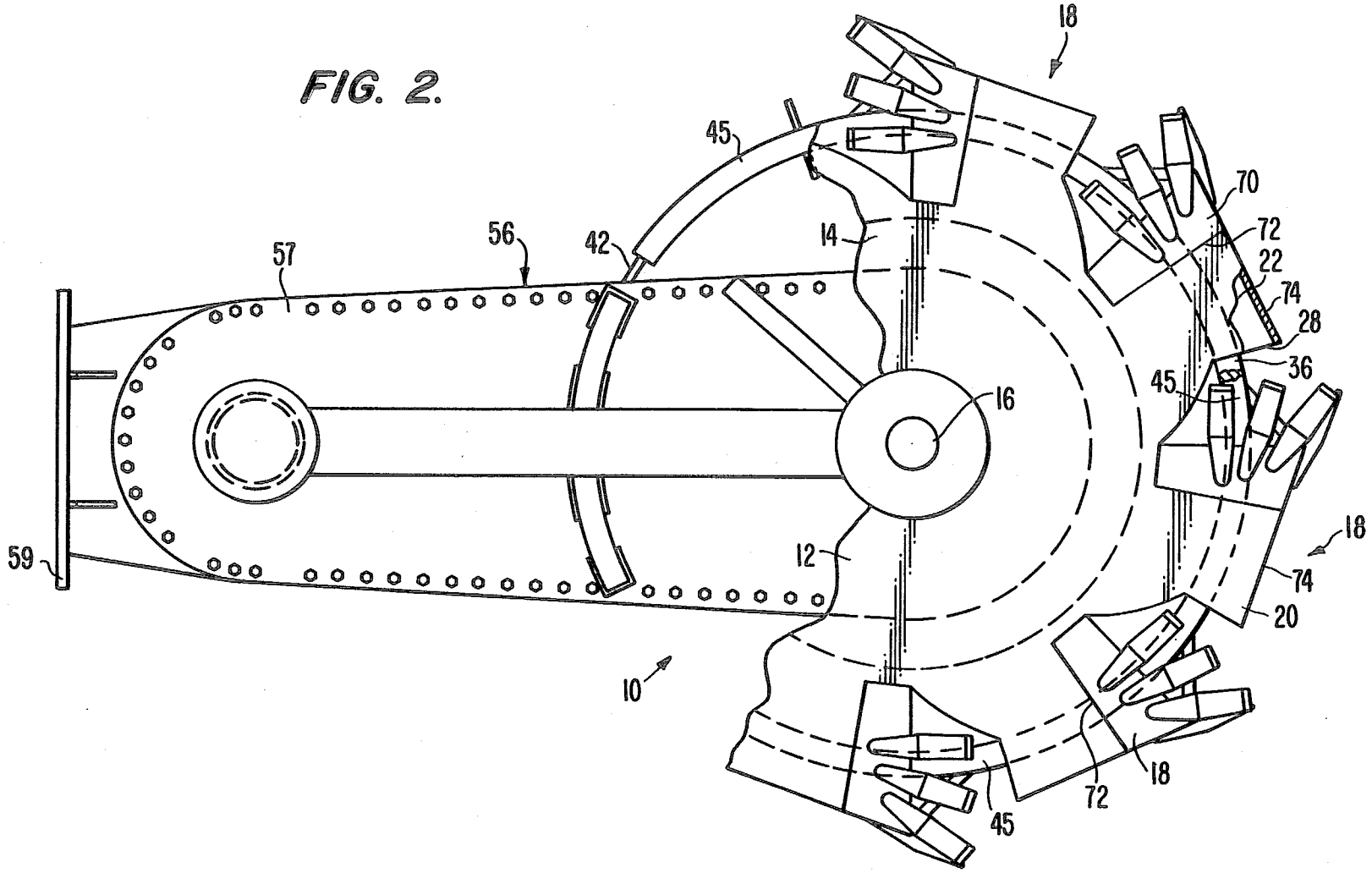
FIG. 2 is a side elevational view partly broken away of the wheel of FIG. 1.

Referring now to the drawings the numeral 10 refers broadly to the cutter wheel of the invention. The wheel is composed of a pair of axially spaced substantially annular plates 12, 14 arranged on a common horizontal axle 16 for rotation in unison. Scoops 18 are uniformly circumferentially spaced about the peripheries of the plates 12, 14 each scoop being defined by a closed outer side wall 20, best seen in FIG. 4, integral with a respective plate 12, 14, a closed top wall 22 extending axially inwardly from the closed outer side wall 20. As can clearly be seen in FIG. 4 each scoop has an open mouth 24 and an open bottom 26, and, as can be seen in FIG. 2, an open rear end 28. Each scoop also has a substantially open inner side 30 (FIG. 4) which is partially closed by an inner side wall 32 extending radially inwardly from the top wall 22 and axially spaced from the outer side wall 20. The inner side wall 32 has an inner edge 34 spaced radially inwardly from the top wall and the inner edges 34 of the inner side walls 32 of all the scoops on each side of the wheel are rigidly interconnected by annular hoop-like members 36.

Figure 3:
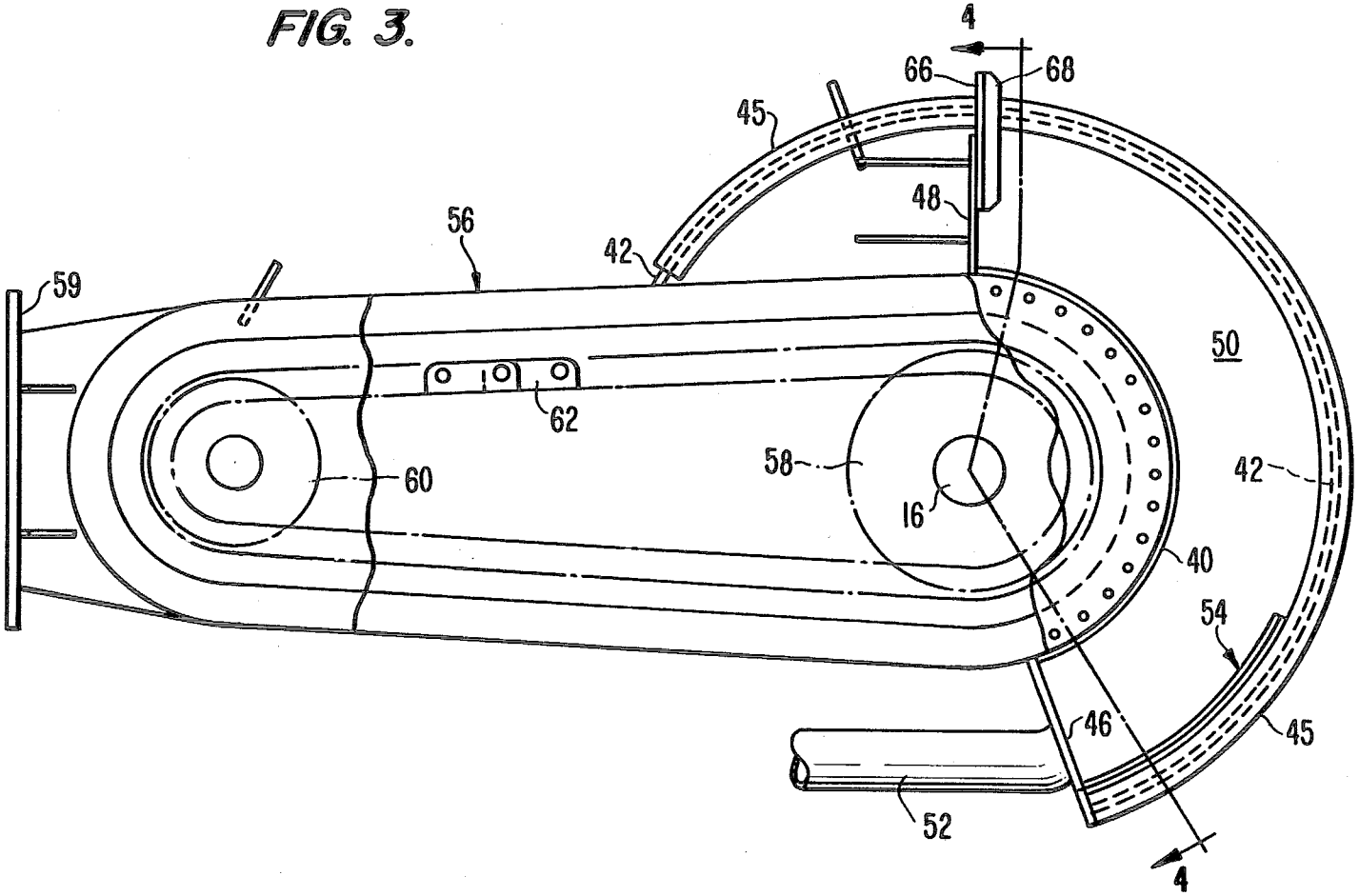
FIG. 3 is a side elevational view with parts removed or broken away for the purpose of clarity.
Figure 4:
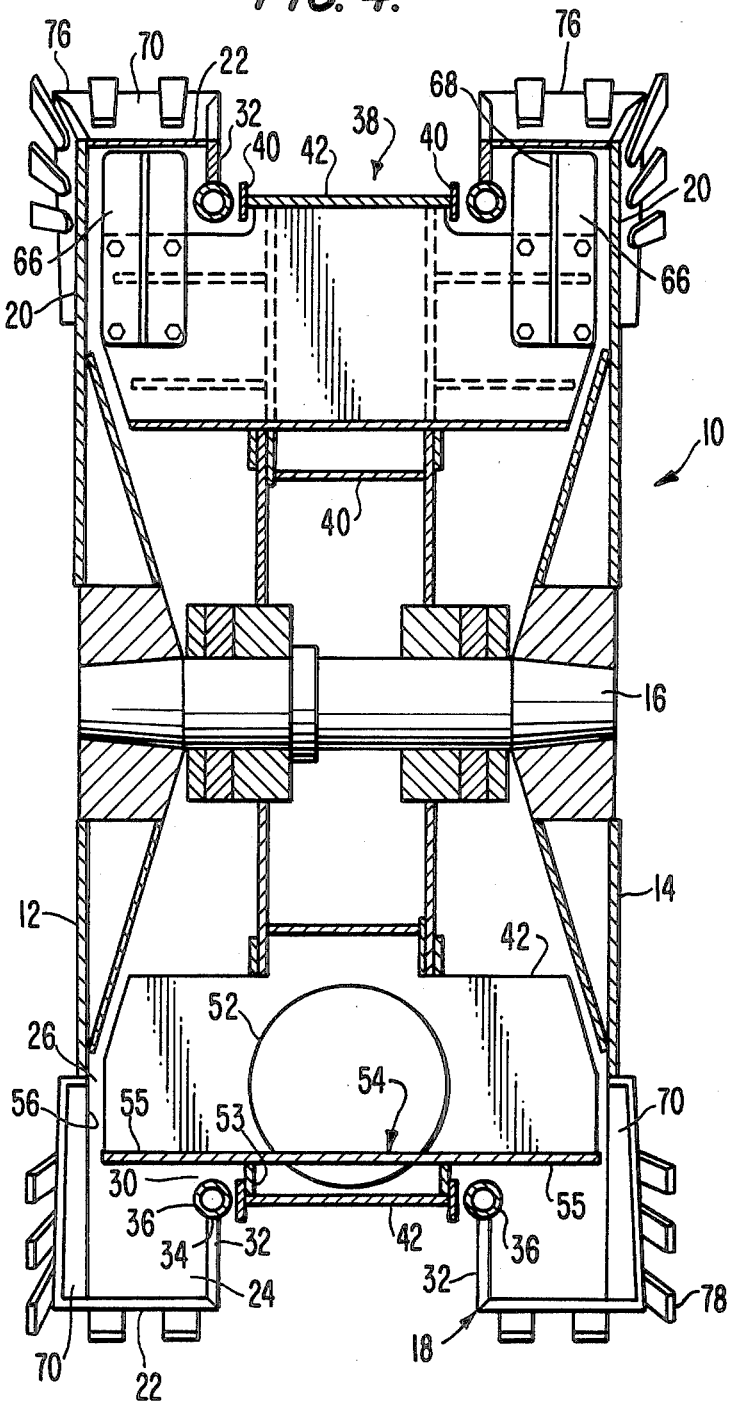
FIG. 4 is an enlarged vertical cross sectional view taken substantially on the line 4—4 of FIG. 2, with certain parts removed for purposes of clarity.

The inner side walls 32 of the sets of scoops on the respective plates 12, 14 are axially spaced from each other and disposed in this axial spacing is a hopper, generally indicated by the numeral 38. As best seen in FIGS. 3 and 4 the hopper is defined by radially spaced arcuate inner and outer walls 40, 42 having an axial width complementary to the spacing between the inner side walls 32 of the scoops. As seen in FIG. 4 the wall 42 is provided with annular stiffening wear flanges 45. The hopper is further defined by lower and upper, circumferentially spaced radial end walls 46, 48 which extend between the radially spaced inner and outer walls 40, 42. Between the inner and outer walls 40, 42, the hopper has axially spaced open outer sides 50 (FIG. 3) with the hopper being open to the sides clear across the width of the hopper. As seen in FIG. 4, the radius of the hopper's outer wall 42 is substantially equal to the radius of the hoop-like members 36 so that the open sides 50 of the hopper substantially align with the open sides 30 of the scoops as the plates 12, 14 are rotated. A suction pipe 52 extends through the lower radial end wall 46 to remove from the hopper spoil flowing axially thereinto through the substantially aligned open sides 30 and 50 of the scoops and hopper, respectively.

With particular reference to FIGS. 3 and 4 it will be seen that the inner face of the outer arcuate wall 42 of the hopper adjacent the lower radial end wall 48 has rigidly fixed thereto, as by brackets 53, a unitary plate 54 having side parts 55 arranged to project axially through the open inner sides 30 of the respective scoops into close adjacency with the inner surface 56 of the outer side wall 20 of the scoops and the radial inner edge of the hoop-like member 36 joining the inner edges 34 of the scoop inner walls 32. As best seen in FIG. 3, the plate 54 extends circumferentially from the lower radial end wall 46 of the hopper a predetermined distance which ensures that spoil in the scoops, upon movement past the plate 54 is directed to the inlet of the suction pipe 52.

Figure 1:
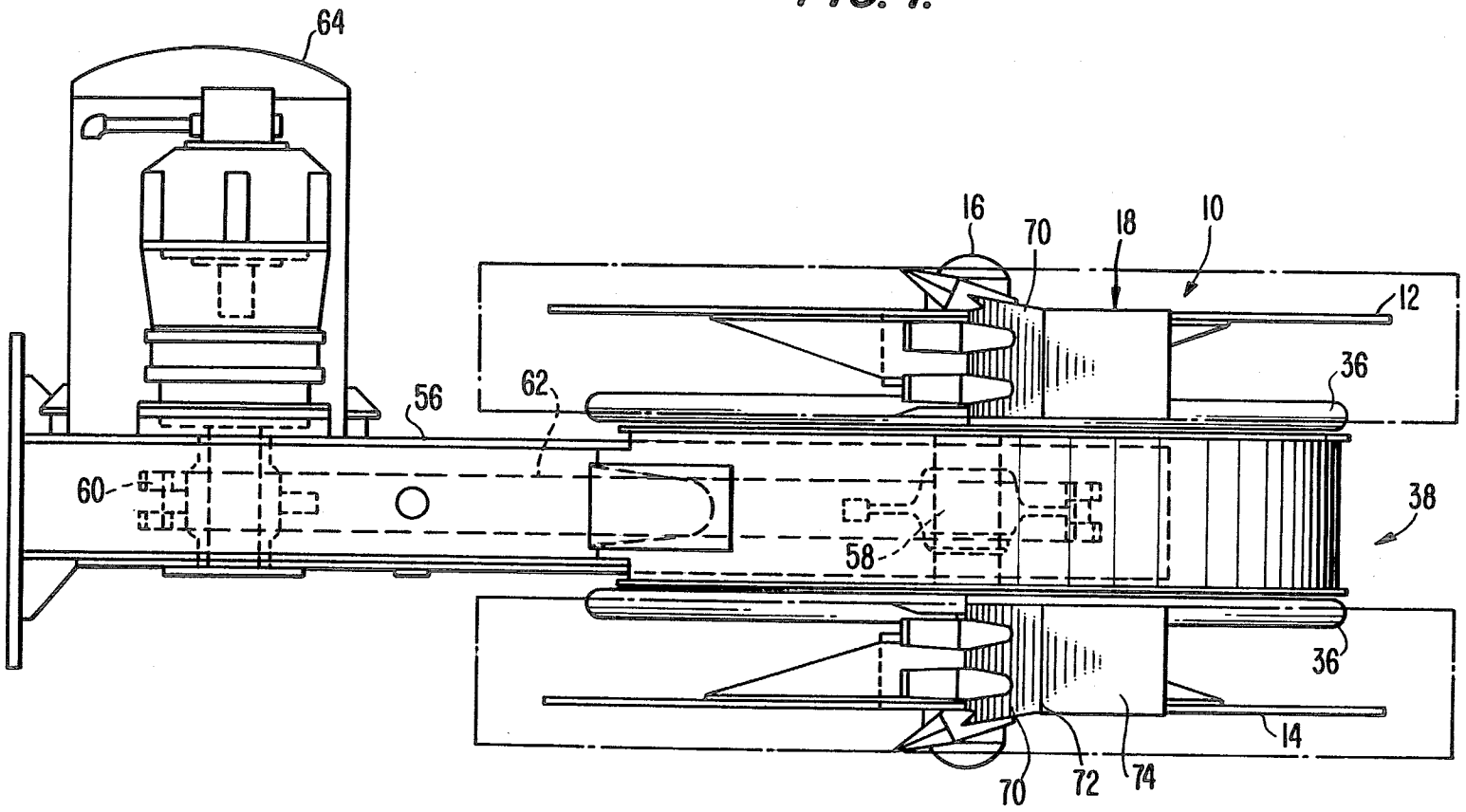
FIG. 1 is a horizontal plan view of the cutter wheel of the invention showing only one set of scoops, the others being removed for the sake of clarity.

With reference to FIGS. 2 and 3 it will be observed that the arcuate inner wall 40 of the hopper is defined by the forward wall part of an elongated housing 56, sealingly closed by a cover 57, which encloses a sprocket wheel 58 (omitted in FIG. 4) drivingly fixed to the axle 16 which passes through the front housing part and carries the annular plates 12, 14 as described. A sprocket pinion 60 is journaled in the rear part of the housing 56 and the sprocket 58 and pinion 60 are drivingly connected by a sprocket chain 62. A power source, such as the sealed, hydraulic motor 64 shown in FIG. 1, is connected to the pinion 60 to drive the same and, through the sprocket chain 62 and sprocket 58, the cutter wheel 10. As can be seen in FIG. 3, the inner end of the housing 56 is provided with a flange 59 whereby the housing may be bolted to the outer end of a dredge ladder.

As best seen in FIGS. 3 and 4, the upper radial end wall 48 of the hopper carries at its ends radially extending wiper arms 66 past which the scoops sweep upon rotation of the wheel to dislodge and direct back into the hopper any spoil still adhering to the interior of the scoops. Each arm 66 may carry on the side thereof opposed to scoop movement at least one vertical fin 68 to aid in breaking up adhering spoil.

As can be seen in FIGS. 1 and 4, the open mouth 24 of each scoop is defined by an outwardly flaring lip 70 whose rear end 72 (FIGS. 1 and 2) is integral with a rearwardly extending part 74 of substantially uniform cross section, preferably rectangular, less than that of the forward edge 76 of the lip 70. The rear of the part 74 defines the open rear end 28 (FIG. 2) of each scoop and is disposed relative to the mouth of the next following scoop to direct spoil passing through the leading scoop directly into the mouth of the next following scoop. Desirably outwardly flaring teeth 78 are rigidly fixed to the outwardly flaring lip of each scoop.

The operation of the cutter wheel of the invention should be clear from the above description. As described, the scoops are open at their sides, bottom and rear. Each scoop digs a load of spoil just prior to passing the lower hopper end plate 46. The arms of the plate 54 provide a floor for the scoops to prevent the spoil from being so diluted by water that it runs out of the scoops before it can reach the intake of the suction pipe 52. The plate 54 extends circumferentially a predetermined distance which is sufficient to ensure that spoil when raised above the upper end of the plate can flow laterally into the hopper and from there into the suction pipe. Lateral flow into the hopper is induced by the suction of pipe 52, it being understood that spoil passing by gravity through the open bottom of the scoops is sucked into the hopper through the open sides thereof in the same manner as spoil flows through the open sides of the scoops when aligned with the hopper sides. In addition, any spoil which is not retained in any scoop flows rearwardly through the open rear end of that scoop into the mouth of the following scoop and, finally, if spoil still adheres in any scoop, it is scraped free by the scraper arm 66.

With a dredge constructed in accordance with the invention, substantially no down time has been required to dislodge sticky spoil and no diversion of power has been required to operate flushing jet streams.

Having now described the invention, what is claimed is:

1. A cutter wheel for a dredge comprising a pair of axially spaced substantially annular plates arranged on a common, horizontal axle for rotation in unison, scoops uniformly circumferentially spaced about the peripheries of said plates, each scoop being defined by a closed outer side wall integral with a respective plate, a closed top wall extending axially inwardly from said outer side wall, an open mouth, bottom and rear and a substantially open inner side, the inner sides of the scoops on one of said plates being axially spaced from the inner sides of the scoops on the other of said plates, a hopper in the axial spacing between the inner sides of the respective scoops, said hopper being defined by radially spaced, arcuate inner and outer walls having an axial width complementary to the spacing between the inner sides of said scoops, upper and lower circumferentially spaced, radial end walls extending between said radially spaced inner and outer walls of said hopper, and axially spaced open outer sides arranged so that the open inner sides of said scoops align therewith as said plates are rotated, and a suction pipe extending through said lower radial end wall for removing from said hopper spoil flowing axially thereinto through the substantially aligned open sides of said scoops and said hopper, respectively.

2. The cutter wheel of claim 1 wherein the inner side of each of said scoops is partially closed by an inner side wall extend radially inwardly from said top wall and axially spaced from said outer side wall said inner side wall having an edge spaced radially inwardly from said top wall, said outer arcuate wall of said hopper adjacent said lower radial end wall being provided with side parts arranged to project axially through the open inner sides of the respective scoops into close adjacency with an inner surface of the outer side walls of said scoops and the radial inner edges of the inner walls of said scoop, said side parts extending circumferentially from the lower radial end wall of the hopper a predetermined distance which ensures that spoil from said scoops upon movement thereof past said side parts is directed to said suction pipe.

3. The cutter wheel of claim 2 wherein said extending side parts of the outer wall of said hopper are extensions of a unitary plate rigidly and concentrically fixed to the inner surface of the outer wall of said hopper.

4. The cutter wheel of claim 2 wherein the inner edges of the inner side walls of said scoops of each side of said hopper are rigidly interconnected by a respective annular hoop-like member.

5. The cutter wheel of claim 1 wherein the arcuate inner wall of said hopper is defined by a forward wall part of an elongated housing, said housing enclosing a sprocket wheel drivingly fixed to an axle passing through said housing and carrying said annular plates, a sprocket pinion journaled in the rear part of the housing, a sprocket chain drivingly connecting said sprocket pinion and wheel, and a power source connected to said pinion to drive the same and through it and said sprocket chain and wheel said cutter wheel.

6. The cutter wheel of claim 1 wherein said upper radial end wall of said hopper carries at its ends radially extending wiper arms past which said scoops sweep upon rotation of said wheel to dislodge and direct back into said hopper spoil adhering to the interior of said scoops.

7. The cutter wheel of claim 6 wherein each arm carries on the side thereof opposed to scoop movement at least one vertical fin to aid in breaking up said adhering spoil.

8. The cutter wheel of claim 1 wherein the open mouth of each of said scoops is defined by an outwardly flaring lip, the rear end of said lip being integral with a rearwardly extending part of substantially uniform cross section less than that of the forward edge of said outwardly flaring lip, the open rear end of said rearwardly extending part being disposed relative to the mouth of the next following scoop to direct spoil passing through said scoop directly into the mouth of said next following scoop.

9. The cutter wheel of claim 8 including outwardly flaring teeth rigidly fixed to the outwardly flaring lips of each of said scoops.

10. The cutter wheel of claim 9 wherein the rearwardly extending part is substantially rectangular in cross section.

11. The cutter wheel of claim 1 wherein the inner side of each of said scoops is partially closed by an inner side wall axially spaced from said outer side wall and having an inner edge spaced radially inwardly from said top wall, annular hoop-like members interconnecting the inner edges of the inner side walls of the scoops on the respective opposite sides of said hopper, the radius of said hoop-like member being substantially equal to the radius of the outer wall of said hopper.

* * * * *